US005465971A

United States Patent [19]

Tischler

[11] Patent Number: 5,465,971

[45] Date of Patent: Nov. 14, 1995

[54] PUTTING TRAINING DEVICE

[76] Inventor: Edward A. Tischler, 350 Auwinala Rd., Kailua, Hi. 96734

[21] Appl. No.: 334,961

[22] Filed: Nov. 7, 1994

[51] Int. Cl.[6] ..... A63B 69/36; A63B 53/14

[52] U.S. Cl. ..... 273/186.2; 273/187.2; 273/81.2; 273/81.3

[58] Field of Search ..... 273/188 R, 189 R, 273/81.2, 81.3, 191 R, 192, 187 R, 193 R, 194 R, 163 R, 163 A, 187.5, 77 R, 186.2, 187.2

[56] References Cited

U.S. PATENT DOCUMENTS

| | | | |
|---|---|---|---|
| 2,949,304 | 8/1960 | Williams | 273/81.3 |
| 3,111,322 | 11/1963 | English | 273/187.5 |
| 3,833,223 | 9/1974 | Shulkin | 273/162 R |
| 3,874,668 | 4/1975 | Flege | 273/81.3 |
| 4,852,877 | 8/1989 | Scalf | 273/81.3 |
| 4,944,516 | 7/1990 | Bickler | 273/183 |
| 5,127,650 | 7/1992 | Schneller | 273/81.3 |
| 5,156,401 | 10/1992 | Hodgkiss | 273/186 |
| 5,328,185 | 7/1994 | Finnigan | 273/81.3 |

*Primary Examiner*—Sebastiano Passaniti
*Attorney, Agent, or Firm*—Brown, Martin, Haller & McClain

[57] ABSTRACT

A putting training device for a golfer that is affixed to a handle end of a putter such that the device projects upwardly from the handle end. The device includes a semi-rigid elongated rod that has an insertion post on one end and a crutch-arm on the other. The insertion post secures the elongated rod within the handle end of the putter, the crutch-arm extending from the insertion post and projecting at an angle from the handle end when the elongated rod is inserted into the handle end. The crutch-arm engages and fits under the rearward armpit of the golfer.

19 Claims, 3 Drawing Sheets

PUTTING TRAINING DEVICE

BACKGROUND OF THE INVENTION

1. Field of the Invention

The present invention relates to a putting training device. More particularly, the present invention relates to a training or instructional device to be used in developing the proper motor skills related to putting, in which a putting training device is affixed to a putter to ensure a proper hinge action between a golfer's rearward shoulder and the radius of the putting stroke.

2. Description of Related Art

In the game of golf, putting generally constitutes more than 40% of the strokes comprising a golfer's score. No other golf club contributes so greatly to a golfer's score. Accordingly, the putter is the most important golf club, and putting is thus the most important aspect of the game of golf.

Because the objective in golf is to complete a round with the fewest number of strokes, a golfer's game will be greatly facilitated by developing an effective and sound putting procedure that can be repeated consistently. To develop an effective and sound putting stroke, the golfer must learn to control the club shaft, the club head, and the club face in such a way as to impart a consistent roll on the golf ball.

A variety of techniques have been introduced for training a golfer to control these aspects of the putting stroke. The most common of these techniques is called the "pendulum stroke."

The pendulum stroke method for putting training, however, does not aid in developing the most natural system of feel or touch while putting. Under this method, the golfer must maintain a constant triangle between the arms and shoulders, thereby establishing a pendulum. The hands and wrists control the putter by holding it without allowing any movement in relation to the triangle. The proper pendulum motion is generated by rocking or rotating the shoulders back and forth around the center of the shoulders. The center of the shoulders thus becomes the pivot point from which the golfer can attain a true pendulum motion.

A device that attempts to train the pendulum stroke method is found in U.S. Pat. No. 5,156,401. That device is designed to produce a strict pendulum motion by forcing a specific geometrical configuration to stay intact while using the muscles of the golfer's shoulders to generate energy and produce feel. Despite the attempt to produce feel using a pendulum motion, this device instead creates a rigidity that reduces feel. It allows the user to experience only a specific type of stroke, preventing any additional arm, wrist, or hand action except as dictated by the shoulders. Additional arm motion, however, is necessary to provide the best possible system of feel.

In addition, it has been discovered that it is just as important for a golfer to experience incorrect activity as correct activity. For a golfer to maintain the proper putting stroke, the golfer must be able to distinguish between both the correct and incorrect putting motions. Once the golfer experiences this distinction, the golfer can select which motion produces the best results. Accordingly, a putting training device should possess less rigidity and a means of biofeedback at the point the device is attached to the putter.

Another putting training device is designed to keep the golfer's right forearm (assuming a right-handed golfer) and putter shaft on the same delivery path during the putting stroke, thus promoting proper shaft and club head delivery.

An example of such a device is provided in U.S. Pat. No. 4,944,516. Other devices have been designed to eliminate breaking-down or cupping of the golfer's left wrist during the putting stroke (again, assuming a right-handed golfer). None of these devices, however, engages either the shoulder or arm-pit areas, thus permitting excessive motion between the golfer's arms and shoulders. In light of the foregoing, a need exists for a putting training device that promotes feel and touch, that provides reduced rigidity and a means of biofeedback at the point the device attaches to the putter, and that engages the golfer's shoulder or arm-pit area, thus limiting excessive motion between the arms and shoulders.

SUMMARY OF THE INVENTION

Accordingly, the present invention is directed to a putting training device, as well as a method for making such a device, that substantially obviates one or more of the problems due to limitations and disadvantages of the related art.

Additional features and advantages of the invention will be set forth in part in the description that follows and in part will be apparent from the description, or may be learned by practice of the invention. The objects and advantages of the invention will be realized and attained by the device particularly pointed out by the written description and claims in this application, as well as in the appended drawings.

To achieve the advantages of the invention and in accordance with the purpose of the invention, as embodied and broadly described herein, the invention is a putting training device for a golfer. The device is affixed to a handle end of a putter such that the device projects upwardly from the handle end. The device includes a semi-rigid elongated rod that has an insertion post for securing the rod within the handle end of the putter. The elongated rod also includes a crutch-arm extending from the insertion post. The crutch-arm projects at an obtuse angle from the handle end of the putter when the elongated rod is inserted into the handle end, whereby the crutch-arm engages the rearward arm-pit of the golfer.

In another aspect, the present invention is a putting training device for a golfer that includes a putter and a semi-rigid elongated rod. The putter has a head end, a handle end, and a shaft connecting the head end to the handle end. The elongated rod includes an insertion post for securing the rod within the handle end, and a crutch-arm extending from the handle end. The crutch-arm projects at an obtuse angle from the handle end such that the crutch-arm engages a rearward arm-pit of the golfer.

In yet another aspect, the present invention is a method for making a putting training device for a golfer. The method includes several steps. First, a bendable and semi-rigid elongated rod is selected that has a golfer end and an insertion end. Second, a crutch-arm is formed in the golfer end of the elongated rod. Next, the golfer sets-up in a putting stance, in which the golfer grips a putter and stands over a golf ball, the putter having a head, a handle, and a shaft. The elongated rod is then fitted to the set-up golfer such that the crutch-arm is engaged under a rearward arm-pit of the golfer, the elongated rod extending from the rearward arm-pit toward the putter handle, the elongated rod thereby intersecting a top of the handle. The rod is then bent at the point of intersection between the rod and the handle's top, such that the rod fits within the handle when the crutch-arm is fitted under the golfer's rearward arm-pit. Finally, the insertion end of the elongated rod is secured within the handle.

It is to be understood that both the foregoing general description and the following detailed description are exemplary and explanatory only and are not restrictive of the invention, as claimed.

The accompanying drawings are included to provide a further understanding of the invention and are incorporated in and constitute a part of this specification, to illustrate the embodiments of the invention, and, together with the description, to serve to explain the principles of the invention.

DETAILED DESCRIPTION OF THE INVENTION

Reference will now be made in detail to the present preferred embodiment of the invention, an example of which is illustrated in the accompanying drawings. Wherever possible, the same reference numbers will be used throughout the drawings to refer to the same or like parts.

Figure 1:
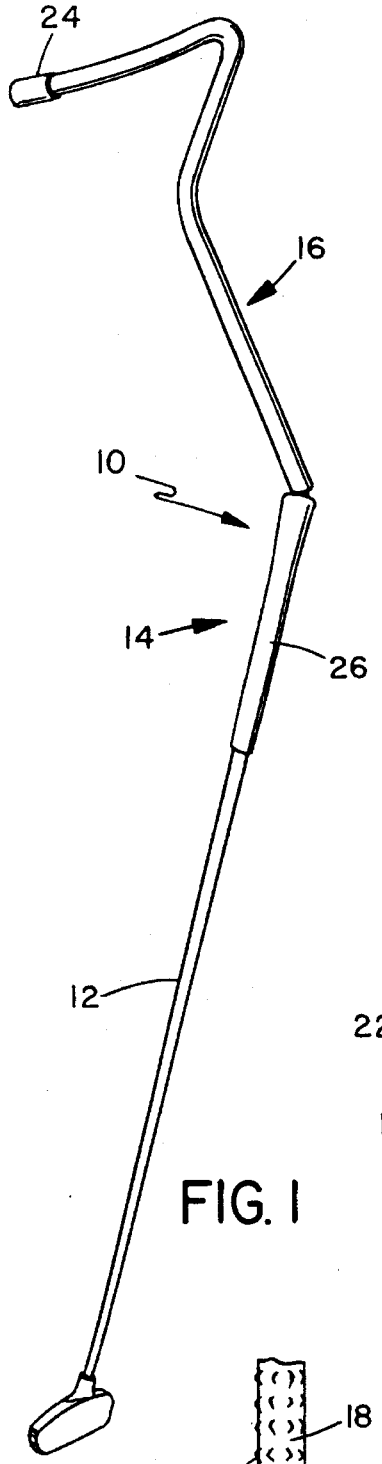
FIG. 1 is a perspective view showing the putting training device as affixed to the handle end of the putter.

Referring to FIG. 1, the putting training device 10 of the present invention comprises an semi-rigid member or elongated rod that is formed to fit under the rearward shoulder of a golfer and to attach to the handle end 14 of a putter 12. The elongated rod includes a crutch-arm 16 formed on one end of the elongated rod, and an insertion post 18 formed on the other end. The putting training device 10 is affixed to the putter 12, with the crutch arm 16 extending from the handle end 14 of the putter 12, and the insertion post 18 being inserted into the handle end 14.

Figure 2:
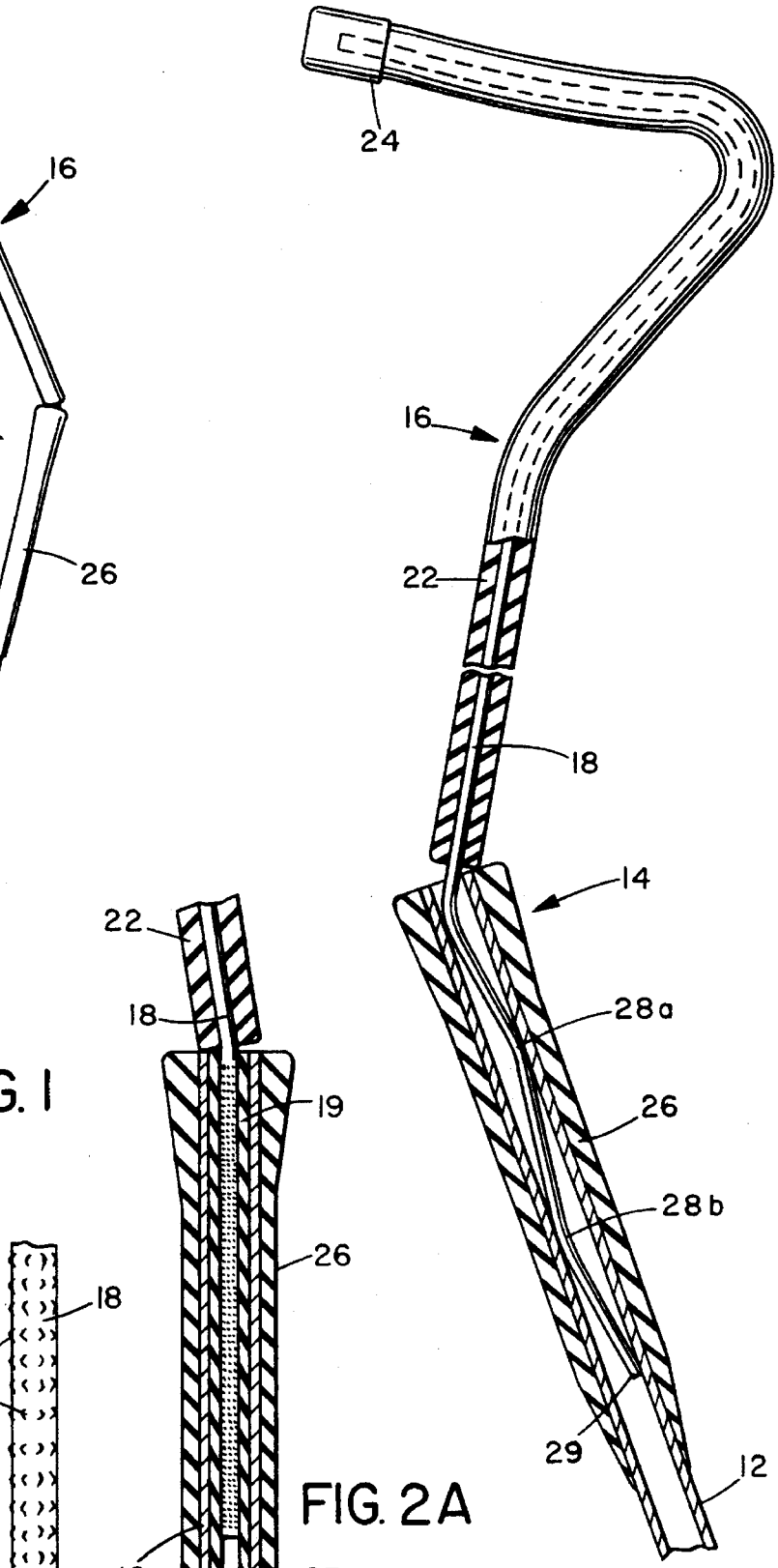
FIG. 2 is a side view of a putter's handle end cut-away showing the putting training device of the present invention secured to the putter.

FIG. 2 illustrates in more detail the putting training device 10 of the present invention. The crutch-arm 16 is formed such that it can be placed and maintained comfortably under the rearward shoulder of the golfer, rearward meaning the right shoulder of a right-handed golfer or the left shoulder of a left-handed golfer. The crutch-arm 16 is covered with an outer hosing 22. This outer hosing is designed to provide cushion for the golfer's arm-pit, as well as to prevent slippage of the crutch-arm within the golfer's arm-pit during a putting stroke. The outer hosing 22 can be made from various materials, including rubber, foam, thermoplastic, or any other material that can be securely fitted over the crutch-arm 14. The outer hosing 22 can be slid over the elongated rod; alternatively it can be a tape-type substance which is wrapped around the elongated rod. To prevent the outer hosing from sliding off the crutch arm, an end cap 24 can be affixed to the end of the crutch-arm.

The elongated rod can be made from any material flexible enough to be bent, but rigid enough to hold in place after being formed and inserted into the handle end 14 of the putter 12. An example of such a material is a steel or aluminum or other bendable rod. As will be apparent to those skilled in the art, other suitable materials also exist. The elongated rod must also be small enough in diameter to fit inside a hole formed in the top of the grip 26 covering the handle end 14 of the putter 12.

As illustrated in FIG. 2, the putting training device 10 is affixed within the handle end 14 of the putter 12 by a series of kinks or bends 28*a*, 28*b* made in the insertion post 18. These kinks 28*a*, 28*b* are formed such that the elbows of the kinks will come into contact with the internal surface of the handle end of the putter, as will the end 29 of the insertion post. In this way, the insertion post 18 will securely hold the putting training device 10 in place and in proper alignment within the handle end 14 of the putter 12. In addition, the angle formed between the crutch-arm 16 and the handle end 14 of the putter 12 will be maintained such that the crutch-arm engages the golfer's arm-pit.

Figure 2A:
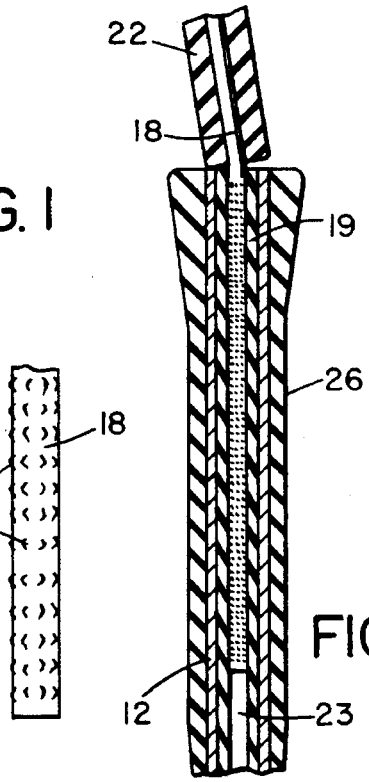
FIG. 2A is a sectional view of another embodiment of the connection of the post of the crutch arm into the handle end of the putter.
Figure 2B:
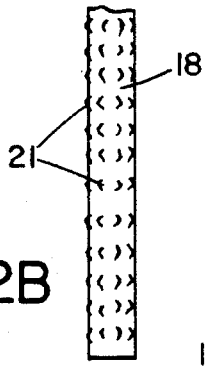
FIG. 2B is a partial view of a roughened outer surface of the post end.

As will be apparent to those skilled in the art, the putting training device 10 can be secured to the putter 12 by means other than the illustrated kinks 28*a*, 28*b*. In another embodiment, see FIGS. 2A and 2B, a foam core or rubber insert 19 is fashioned to fit securely within the handle end 14. Preferably in a manner such that the core 19 does not rotate relative to the club handle end 14. The foam core or rubber insert is hollowed out providing a hole 23 at its center to such a diameter that an unbent insertion post 18 could be snugly fitted, without excessive rotations, within the diameter of the foam core or rubber insert 19. The handle end 14 can be rotated to correctly align the crutch-arm to the golfer. The outer surface of the lower end of the post 18 can also be roughened 21 to resist excessive or easy rotation in the hole 23. In this way, the foam core or rubber insert would provide a means for attaching the putting training device 10 to the putter 12 without the need to make kinks 28 in the insertion post 18.

Figure 3A:
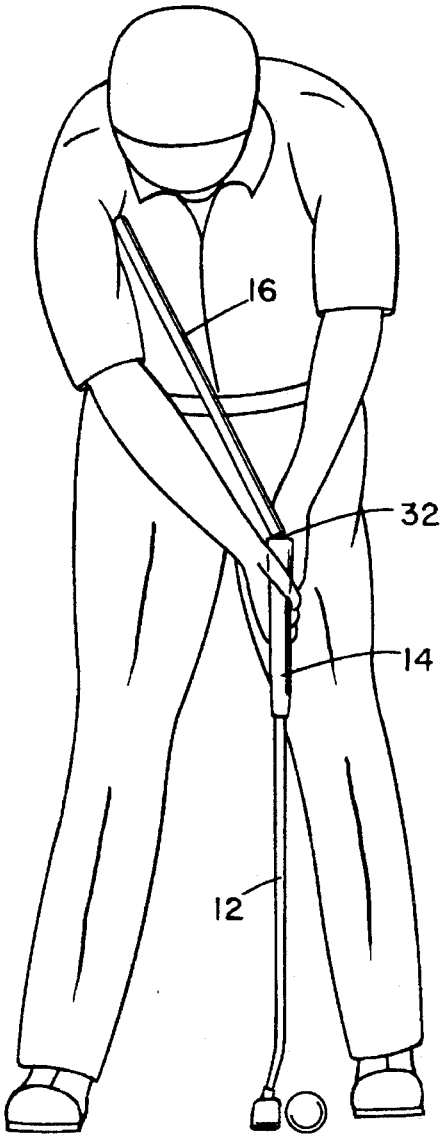
FIG. 3A is a front view showing the putting training device of the present invention being fitted to a golfer.
Figure 3B:
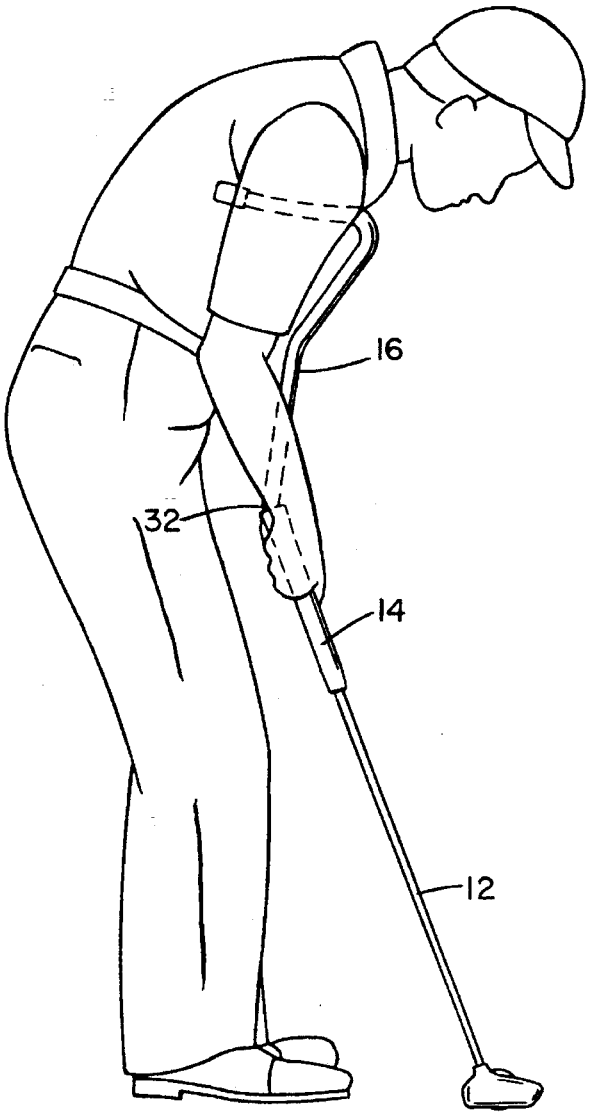
FIG. 3B is a side view of the arrangement of FIG. 3A.
Figure 4:
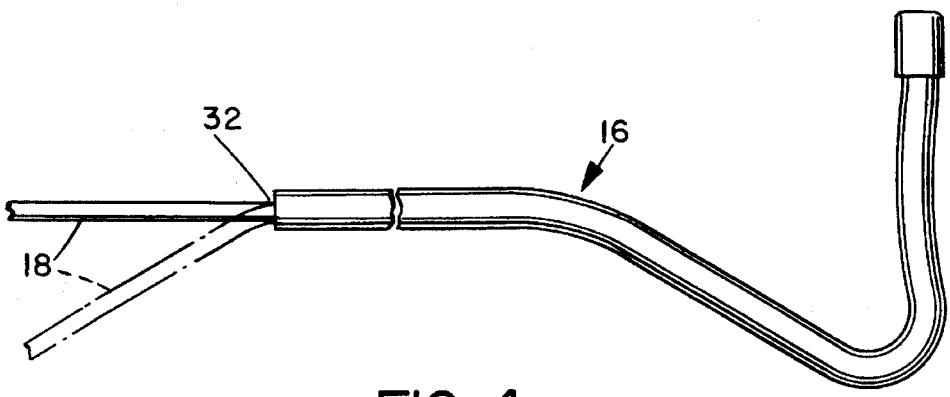
FIG. 4 is a side view of the putting training device of the present invention illustrating where the device is bent before insertion into the handle end of a putter.

Referring now to FIGS. 3 and 4, the method of making the putting training device 10 will be described. First, the elongated rod is covered with the outer hosing 22, and the crutch-arm 16 is formed. Second, as illustrated in FIGS. 3A and 3B, the golfer sets-up to the golf ball in the golfer's normal putting stance. The golfer (or someone else) then places the putting training device, with the crutch-arm 16 already formed, under the golfer's rearward shoulder. The elongated rod is then manipulated such that it intersects the top of the handle end 14 of the putter 12. This point of intersection 32 is then marked and the outer hosing removed from the elongated rod from that point 32 to the end of the insertion post 18.

As illustrated in FIG. 4, the elongated rod is bent at the point of intersection 32 such that the insertion post 18 will parallel the handle end of the putter. In this way, when the crutch-arm 16 is fitted to the arm-pit of the golfer, and when the golfer stands over the golf ball, the insertion post 18 will fit properly within the putter's handle end. Referring again to FIG. 2, in order to secure the insertion post 18 within the handle end 14, at least one kink 28*a*, 28*b* is made in the insertion post, thereby providing contact between the insertion post and the internal surface of the handle end. Preferably, the kinks 28*a*, 28*b* are made such that the insertion post 18 contacts the inner surface of the handle end 14 at three separate points 28*a*, 28*b*, 29.

The putting training device 10 is designed to help a golfer develop the proper hinging action at the rearward shoulder in order to develop a unique putting technique called the "push-it" stroke. The push-it stroke is based on the premise that the golfer should control the putting stroke with a pushing action of the rearward arm. This will help provide more control and feel to the golfer. A pushing type motion provides a measurably more efficient and stable roll than a pulling type motion, as well as more sensitivity or touch than a pendulum stroke. A pushing stroke thus provides the best possible roll in a golf ball, as compared to the roll produced by a swinging or hitting type stroke.

Beyond the type of putting motion necessary, certain imperatives must be established and maintained to achieve a consistent roll and touch. These imperatives are: (1) The radius of the putting stroke must remain constant; (2) the putting stroke must provide an accelerating clubhead through the impact interval; and (3) a system of touch (or feel) must be attainable and sustainable.

Figure 5B:
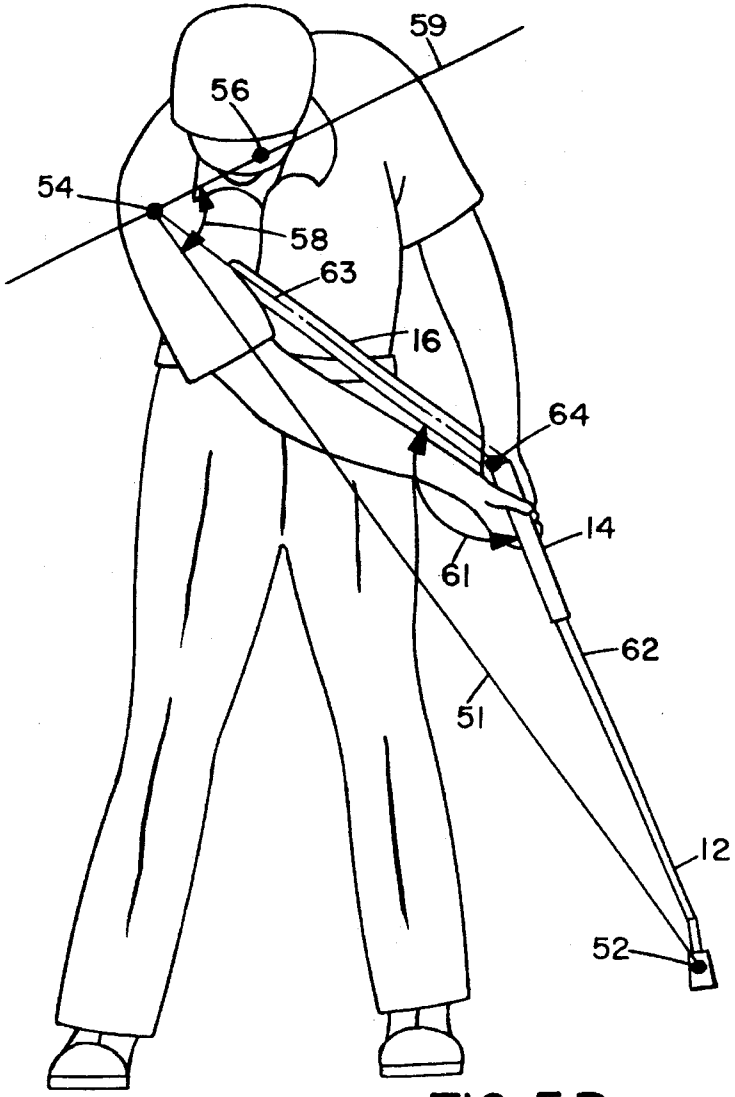
FIGS. 5A and 5B are front views showing the radius and alignment of the putting stroke using the present invention.
Figure 5A:
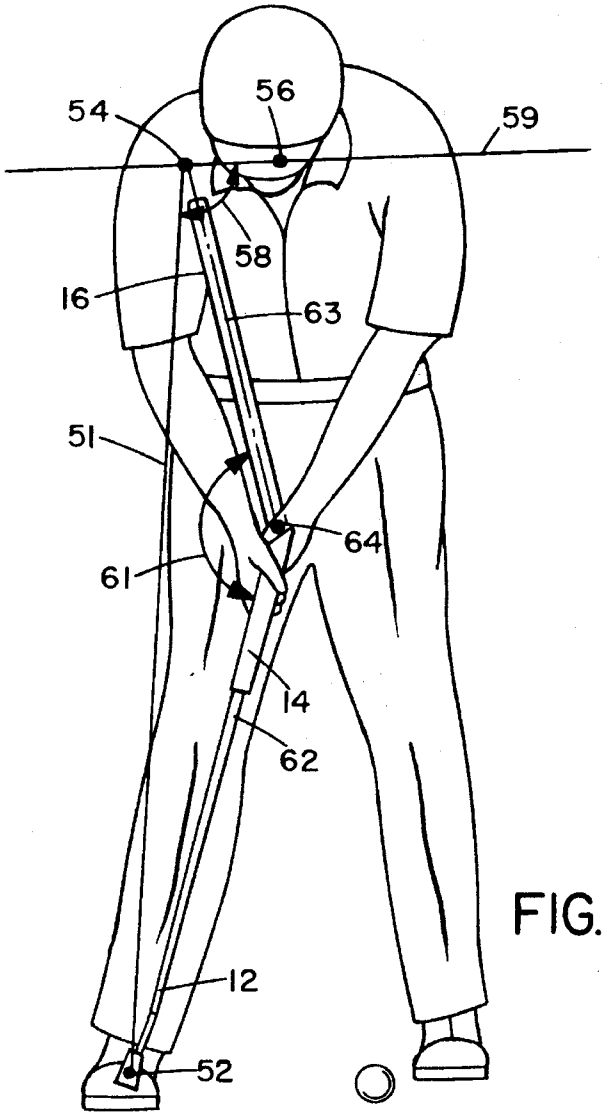

As illustrated in FIGS. 5A and 5B, the swing radius of the pushing stroke is a line segment 51 joining the center of the putter head 52 and the center of the rearward shoulder 54. Ease of acceleration is achieved by making a shorter backstroke than throughstroke. Feel in the putting stroke can be achieved through the hands and wrists, or the larger muscles of the shoulders. Nevertheless, using the hands and wrists is generally considered inconsistent as far as control is concerned, despite providing heightened touch. Using the arms and shoulders as a unit (i.e., a pendulum motion) utilizes the larger muscles of the shoulders for feel, and is generally considered to be more consistent. This motion does not, however, provide the best touch. A combination of the shoulders pivoting and the arms hinging with minimal or no wrist action, therefore, will provide both touch and consistency.

The putting training device 10 ensures that the length of the radius of the putting stroke remains constant by maintaining a constant angle 61 between the shaft 62 of the putter and a line 63 connecting the center of the top of the putter grip 64 and the center of the rearward shoulder 54. The present invention also maintains a constant distance between the center of the top of the putter grip 64 and the center of the rearward shoulder 54 via the crutch-arm 16. If a golfer can maintain constant (1) the length of the putter, (2) the length between the center of the top of the putter grip 64 and the center of rearward shoulder 54, and (3) the angle 61 between these two lengths, the length of the radius of the putting stroke will also remain constant.

The radius of the putting stroke is shown as a constant, as designated by the line segment 51 joining the center of the rearward shoulder 54 and the center of the putter head 52. The center of the shoulder pivot is designated by reference numeral 56, and the angle between the stroke radius and the shoulder line is designated by reference numeral 58. As can be seen in FIGS. 5A and 5B, the stroke radius defined by line segment 51 remains constant throughout the putting stroke, while the angle 58 between the stroke radius and the shoulder line 59 is variable.

The present invention also promotes square alignment of the putter face to the putting training device 10 and the delivery path of the radius of the pushing stroke, while allowing the golfer to sense any movement causing misalignment. The design of the insertion post 18 facilitates this feature of the putting training device 10. The insertion post 18 must be stiff enough to maintain its basic form during insertion into the handle end 14 of the putter 12, while being flexible enough to allow the insertion post to reflex against the inside of the putter shaft, thereby securely holding the putter in proper alignment to the putting training device.

Nevertheless, the reflex tension of the insertion post 18 must allow for adjustments in alignment during the set-up procedure, and to give way to severely forced improper movements during practice. As the user forces such movements, the device will provide sensory feedback to the user of any improper movements. By supplying the appropriate sensory feedback, the putting training device 10 will help to secure a golfer's ability to consistently perform the proper putting set-up and push-it putting stroke each time the golfer puts.

It will be apparent to those skilled in the art that various modifications and variations can be made in the present invention without departing from the spirit or scope of the invention. Thus, it is intended that the present invention cover the modifications and variations of this invention, provided they come within the scope of the appended claims and their equivalents.

What is claimed is:

1. A putting training device for a golfer, said device being affixed to a handle end of a putter such that said device projects upwardly from said handle end, said device comprising:

a semi-rigid elongated rod, including:

an insertion post for securing said elongated rod within said handle end of said putter; and a crutch-arm extending from said insertion post, said crutch-arm projecting at an obtuse angle from said handle end of said putter when said elongated rod is inserted into said handle end, whereby said crutch-arm engages a rearward armpit of a golfer when the golfer grips said handle end of said putter.

2. The putting training device recited in claim 1, further comprising an outer hosing surrounding the crutch-arm.

3. The putting training device recited in claim 1 wherein the handle end of the putter has an inside surface and an outside surface, and wherein the insertion post includes at least one kink along its length, said at least one kink contacting said inside surface of the handle end when the insertion post is inserted into the handle end.

4. The putting training device recited in claim 3 wherein the obtuse angle remains substantially constant throughout a putting stroke.

5. The putting training device recited in claim 2, further comprising a cap end, said cap end being affixed to an end of the crutch-arm.

6. The putting training device recited in claim 1 wherein the putter has a shaft, wherein the handle end of the putter has a top, wherein a golfer has a rearward shoulder, a constant angle being maintained between said shaft and a line connecting said top of the handle end to the rearward shoulder throughout a putting stroke of the golfer.

7. The putting training device recited in claim 1 wherein a constant distance is maintained between the top of the putter and the rearward shoulder.

8. A putting training device for a golfer, said device comprising:

a putter having a head end, a handle end, and a shaft connecting said head end to said handle end; and a semi-rigid elongated rod, extending from the handle end of said putter, and a crutch-arm extending from said rod, said crutch-arm projecting at an obtuse angle from said handle end, whereby said crutch-arm engages a rearward armpit of a golfer when the golfer grips said handle end of said putter.

9. The putting training device recited in claim 8, further comprising an outer hosing surrounding the crutch-arm.

10. The putting training device recited in claim 9, further comprising a cap end, said cap end being affixed to an end of the crutch-arm.

11. The putting training device recited in claim 8 wherein the handle end of the putter has a cylindrical opening with an inside surface and an outside surface; and a lower end of said rod forming a post that is inserted into said cylindrical opening.

12. The putting training device recited in claim 11 wherein the insertion port includes at least one kink along its length, said at least one kink contacting said inside surface of the handle end.

13. The putting training device recited in claim 8 wherein the obtuse angle remains substantially constant throughout a putting stroke.

14. The putting training device recited in claim 8 wherein the putter has a shaft, wherein the handle end of the putter has a top, wherein a golfer has a rearward shoulder, a constant angle being maintained between said shaft and a line connecting said top of the handle end to the rearward shoulder throughout a putting stroke of the golfer.

15. The putting training device recited in claim 14 wherein a constant distance is maintained between the top of the putter and the rearward shoulder.

16. A method for making a putting training device for a golfer, comprising:

selecting a bendable and semi-rigid elongated rod, said elongated rod having a golfer end and an insertion end;

forming a crutch-arm in said golfer end of said elongated rod;

setting up a golfer in a putting stance, the golfer gripping a putter and standing over a golf ball, said putter having a head, a handle end, and a shaft connecting said head to said handle end;

fitting said elongated rod to the set-up golfer such that said crutch-arm is engaged under a rearward armpit of the golfer, said elongated rod extending from said rearward armpit toward said handle end of said putter such that said elongated rod intersects a top of said handle end;

bending said elongated rod at a point where said elongated rod intersects said top of said handle end, such that said elongated rod fits within said handle end when said crutch arm is fitted under said rearward armpit;

securing said insertion end of said elongated rod within said handle end.

17. The method for making the putting training device recited in claim 16, further comprising the steps of:

fitting an outer hosing around said elongated rod; and removing said outer hosing between the intersection point and the insertion end.

18. The method for making the putting training device recited in claim 16 wherein the bending step further includes the substep of:

forming at least one kink in the insertion end of the elongated rod.

19. The method for making the putting training device recited in claim 16 wherein the putter has a grip surrounding the handle end; and wherein the securing step further includes the substeps of:

cutting a hole in a top of said grip, and inserting the insertion end of the elongated rod into the handle end through said hole.

* * * * *